United States Patent [19]

Connelly

[11] Patent Number: 4,953,576

[45] Date of Patent: Sep. 4, 1990

[54] METHOD AND APPARATUS FOR STAKING ARTICLES TO A GROUND SURFACE

[76] Inventor: Thomas R. Connelly, 423 Pratt St., Niles, Ohio 44406

[21] Appl. No.: 345,991

[22] Filed: May 2, 1989

[51] Int. Cl.[5] ..... E04H 15/62

[52] U.S. Cl. ..... 135/118; 135/905; 24/129 R

[58] Field of Search ..... 135/118, 905; 24/129 R, 24/115 K

[56] References Cited

U.S. PATENT DOCUMENTS

| | | | |
|---|---|---|---|
| 362,183 | 5/1887 | Runyon | 135/118 X |
| 716,010 | 12/1902 | Eldridge . | |
| 1,427,889 | 9/1922 | Wittmann . | |
| 2,712,864 | 6/1955 | Clevett, Jr. . | |
| 2,781,568 | 2/1957 | Graham | 24/129 R |
| 3,160,979 | 12/1964 | Bissell | 24/129 R X |
| 3,182,672 | 5/1965 | Biller, Jr. | 135/118 X |
| 3,241,202 | 3/1966 | Knauft | 135/118 X |
| 3,677,543 | 7/1972 | Richardson | 24/129 R X |
| 3,732,878 | 5/1973 | Blankemeyer et al. | 135/118 |
| 4,263,925 | 4/1981 | Arganbright . | |
| 4,699,165 | 10/1987 | Barzana | 135/118 |

FOREIGN PATENT DOCUMENTS

| | | | |
|---|---|---|---|
| 72392 | of 1951 | Denmark | 24/129 |
| 3702 | of 1919 | Netherlands | 24/129 |
| 0014621 | of 1886 | United Kingdom . | |
| 14621 | of 1888 | United Kingdom | 135/118 |
| 0024029 | of 1911 | United Kingdom . | |

*Primary Examiner*—David A. Scherbel
*Assistant Examiner*—Lan Mai
*Attorney, Agent, or Firm*—Leydig, Voit & Mayer

[57] ABSTRACT

A method is disclosed for securing an article to a ground surface using an elongated stake having a sharp first end of a body portion for driving into a ground surface and a blunt second end for receiving a driving force and transferring it to the body portion. A rope extends from the article and forms a loop at its free end. The loop is drawn through a ring-shaped outrigger pivotably mounted to the body portion of the stake. After passing through the ring-shaped outrigger, the eye of the loop is passed over the blunt second end of the body portion of the stake. The rope is made taut by pulling the free end of the rope so as to enlarge the loop, thereby taking up slack in the portion of the rope spanning the article and stake.

3 Claims, 2 Drawing Sheets

METHOD AND APPARATUS FOR STAKING ARTICLES TO A GROUND SURFACE

TECHNICAL FIELD

The invention in general relates to devices for stabilizing an article and, more particularly, to staking devices for anchoring tents and the like to a ground surface.

BACKGROUND

For centuries, stakes for driving into a ground surface have been used to secure articles such as tents whose framework rest on a ground surface and without additional support are unstable. To secure and stabilize the framework of a tent, for example, ropes typically extend from a canvas portion of the tent and are tied to a stake driven into the ground surface.

The simplest form of a stake for securing the stabilizing ropes is a simple elongated metal bar or wooden stick with a sharpened end for driving into the ground surface. In driving such stakes into the ground surface, care must be taken to drive it in at a angle with respect to vertical which is sufficient to ensure the rope will not slip off the stake when under tension. If the angle is insufficient, the rope can walk up the stake and slip over its top.

In order to make the reliability of stakes less dependent on how they are driven into a ground surface, it is known to attach outriggers to the top portion of stakes. These outrigger structures stop a rope from walking up the stake and slipping over its top by extending transversely from the body of the stake, requiring either that the rope be slackened or untied in order to release it from the stake. Although these types of stakes are more reliable than a simple elongated bar or stick, the outrigger structure makes adjustment of the tension in the rope more difficult.

SUMMARY OF THE INVENTION

It is a primary object of the invention to provide an apparatus and method using ropes for securing tents and the like which is not susceptible to the accidental release or slippage of the rope from its mooring, yet also allowing for easy adjustment of the rope to draw it taut.

It is also an object of the invention to provide the foregoing apparatus and method wherein the apparatus is rugged and inexpensive to manufacture.

Briefly, the invention utilizes a stake having a bore in an upper body portion, where the bore is oriented to be essentially transverse to the longitudinal axis of the stake and receives a ring which is freely movable in the bore. The position of the bore along the length of the stake and the diameter of the ring are such that the ring cannot pivot in the bore over the top of the stake.

To secure one end of the rope to the stake, a loop is first formed in one end of the rope. The loop is passed through the ring from its underside as it is held outwardly from the surface of the body of the stake. As the loop is passed through the ring, the eye of the loop is drawn over and around the top of the stake. Application of tension to the rope attempts to pull the loop back out of the ring; however, the loop surrounds the top of the stake and thereby cannot be withdrawn from the ring. In a complementary fashion, the ring prevents the rope from walking to the top of the stake and slipping free. The loop in the rope is held together by a simple brace which also serves to adjust and hold tension in the rope.

Because of the annular shape of the ring, the rope can smoothly move through the ring as it is made taut. Preferably, the body of the stake is cylindrical in shape to complement the curved surfaces of the ring and thereby provide additional ease of rope adjustment.

Other objects and advantages of the invention will be apparant from the following detailed description and the accompanying drawings.

While the invention will be described in connection with securing a tent, it will be understood and appreciated that it is not intended to be limited to such use. On the contrary, the invention is intended to cover all applications which may require the securing of an article to a ground surface.

DETAILED DESCRIPTION OF THE PREFERRED EMBODIMENT

Figure 1:
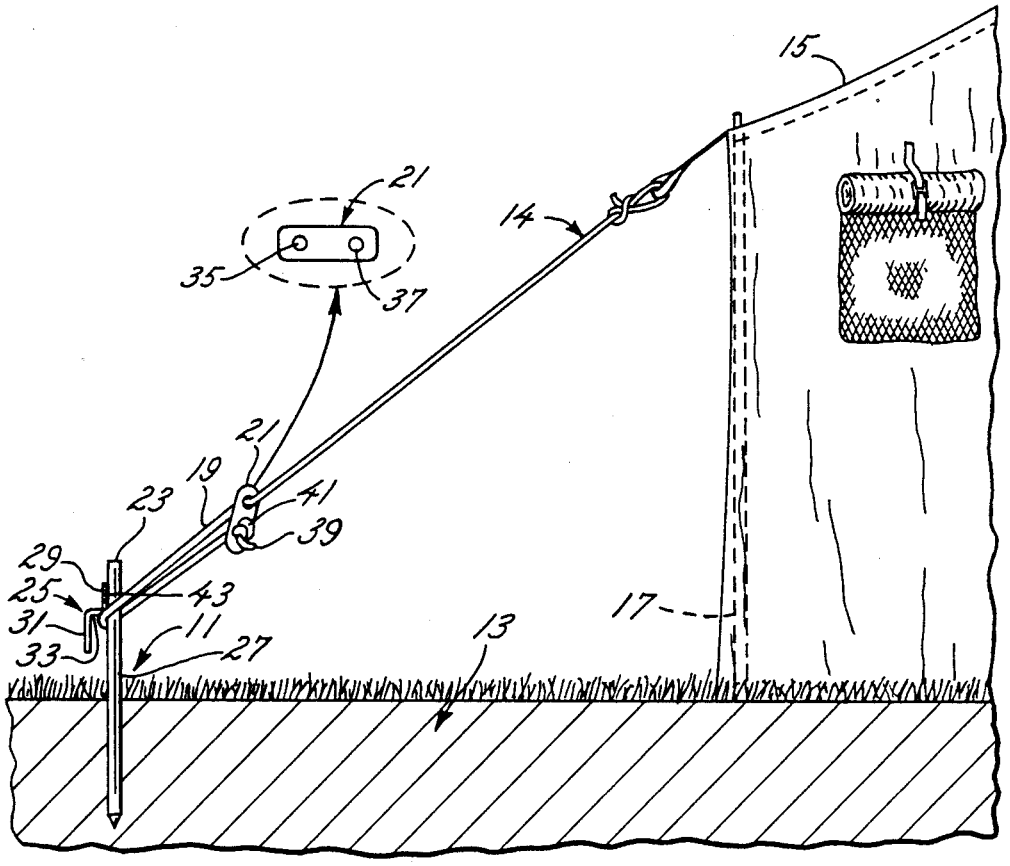
FIG. 1 (PRIOR ART)
FIG. 1 is a schematic illustration of a prior art stake which utilizes an outrigger structure for preventing a secured to the stake from accidentally slipping away.

Turning to the drawings and referring first to FIG. 1, a prior art stake 11 is driven into a ground surface 13 and serves as a means for tying down a rope 14 extending from a corner of a tent 15. In a conventional fashion, the tent 15 includes a framework comprising pole members 17 which sit on the top of the ground surface. To provide stability and secure the structure of the tent in place, the rope 14 is secured in a conventional manner to one corner of the tent 15 and extends to the stake 11 embedded in the ground surface 13. As is well-known, a plurality of stakes and ropes are typically used in order to provide stability to the tent 15 and its framework.

To secure the rope 14 about the stake 11, a loop 19 is formed in one end of the rope and held in place by a brace 21. With the rope 14 slack, the eye of the loop 19 is passed over a first end 23 of the stake 11. In order to prevent the rope 14 from walking up the stake 11 and releasing from it, an outrigger 25 is welded to the body or shank portion 27 of the stake 11. The outrigger 25 includes two vertical portions 29 and 31 spaced by a horizontal portion 23. One vertical portion 29 is welded to the body 27 of the stake 11. The horizontal portion 33 is intended to act as a stop for the rope 14, preventing it from slipping over the top of the stake 11. The second vertical portion 31 provides assurance that the rope 14 will not release from the stake 11 if it is driven into the ground surface 13 at an angle which tilts the stake in the direction of the tent 15.

In addition to holding the loop 19 in place, the brace 21 also serves as a mechanism for adjusting and holding tension in the rope 14. In the illustrated embodiment, the brace is a simple unitary piece of metal having two adjacent holes 35 and 37. To form the loop 19, the free end 39 of the rope 14 is passed through a first one of the holes 35 from a first side of the brace 21. The second hole 37 receives the free end 39 of the rope 14 from a second side of the brace 21, thereby forming the loop 19. After the free end 39 of the rope 14 has passed through the two holes 35 and 37 of the brace 21, a knot 41 is tied into the free end so as to create an area proximate the free end which has a diameter larger than the second hole of the brace. By preventing the free end 39 of the rope 14 from being withdrawn from the second hole 37, the brace 21 and knot 41 cooperate to hold the loop 19 in place.

With the loop 19 placed over the stake 11, the free end 39 of the rope 14 is pulled upon in order to draw the rope taut between the stake and the tent 15. Drawing the rope 14 taut creates tension along the length of the rope. When the drawing force is removed, the rope 14 exerts a force on the brace 21 in an attempt to release the tension. Specifically, the portion of the rope 14 passing through the first hole 35 of the brace 21 experiences a tension in a first direction, whereas the portion of the rope passing through the second hole 37 of the brace experiences tension in an opposite direction. The opposing tensions create a torque about the brace 21 which functions to bind in place the portions of the rope 14 passing through the holes 35 and 37 as explained more fully hereinafter.

Pulling on the free end 39 of the rope 14 in order to take up the slack between the tent 15 and the stake 11 causes a portion of the rope to pass under the outrigger 25. As the rope 14 is made taut, it is pulled into a corner 43 formed by the weld between the outrigger 25 and the body portion 27 of the stake 11. The rough and relatively angular interface characterized by such a weldment tends to snag the rope 14, making final adjustment of tension in the rope difficult.

In accordance with one important aspect of the invention, an inexpensive stake is provided which secures the rope 14 as equally well as the stake of FIG. 1, while presenting only smooth surfaces where the rope engages the stake, thereby allowing for easy final adjustment of tension in the rope. A bore in an upper area of the body portion of the stake receives a ring mounted to freely pivot in the bore. Preferably, both the body of the stake and the ring are made of a steel alloy typically used in the art for ground stakes. Also, the body portion of the stake is preferably cylindrical in order to present only rounded surfaces to the rope.

Figure 2:
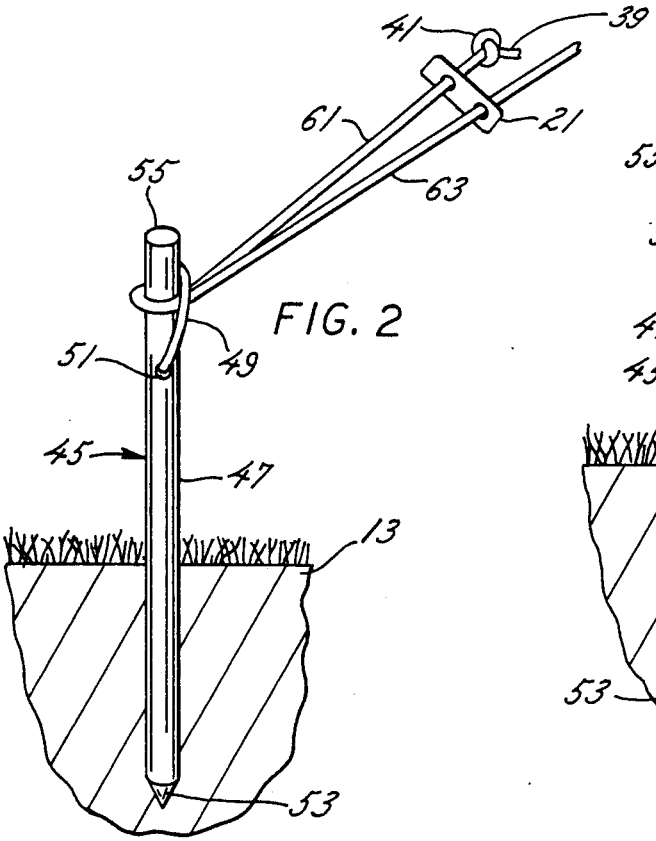
FIG. 2 is an illustration of a stake securing a rope according to the invention.

Referring to FIG. 2, a stake 45 comprises a body portion 47 and a ring 49 mounted to a transverse bore 51 in an upper area of the body portion. The ring 49 is free to pivot in the bore 51 and is sized to have a diameter which is sufficient to easily receive the loop 19 of the rope 14. The bore 51 is positioned on the body or shank portion 47 of the stake 45 such that the ring 49 cannot be pivoted over the top of the body portion.

In a conventional manner, the body or shank 47 of the stake 45 is an elongated, preferably cylindrical, bar having a sharp first end 53 for driving into the ground surface 13 and a blunt second end 55 for transferring a driving force to the body. To secure the rope 14, extending from the tent 15 (FIG. 1), to the stake 45 of FIG. 2, the same loop 19 held by brace 21 is employed as indicated by FIG. 2.

Figure 3A:
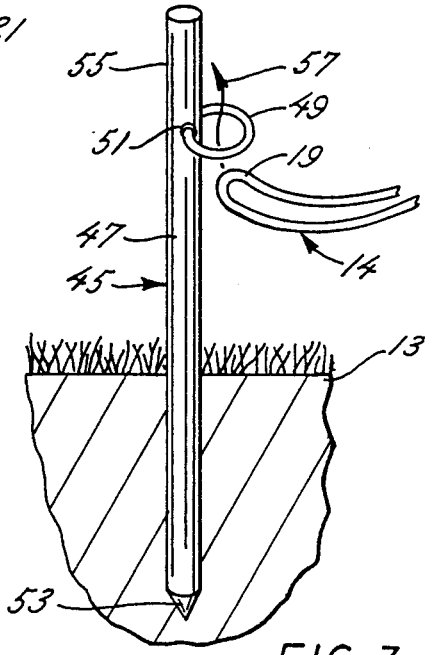
FIGS. 3*a*–3*d* illustrate in time sequence the steps for securing or tying down an article in accordance with the invention.
Figure 3B:
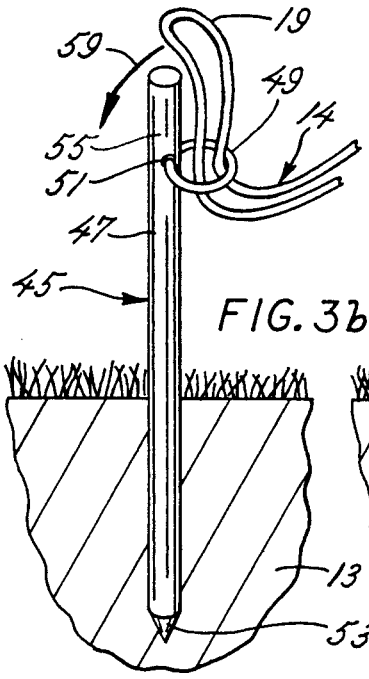
Figure 3C:
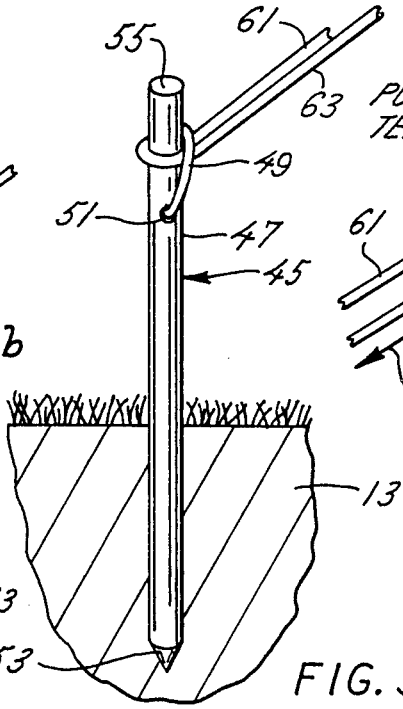

In accordance with another important aspect of the invention, the rope 14 is secured to the stake 45 by holding the ring 49 away from the body 47 of the stake as illustrated in FIG. 3*a* and drawing the loop 19 of the rope through the underside of the ring as indicated by the arrow 57 in FIG. 3*a*. As the loop 19 is drawn through the ring 49, the eye of the loop is passed over the second end 55 of the stake 45 as indicated by the arrow 59 in FIG. 3*b*. With the loop 19 placed around the body 47 of the stake 45 as indicated in FIG. 3*c*, the rope 14 is secured to the stake. As slack is taken from the length of the rope 14 spanning the tent 15 and the stake 45, the loop is drawn toward the top or second end 55 of the stake. The ring 49, however, stops the loop 19 from walking up the body 47 of the stake 45 and becoming free from it. Moreover, the loop 19 cannot withdraw from the ring 49 because it is wrapped about the body 47 of the stake 45.

Figure 3D:
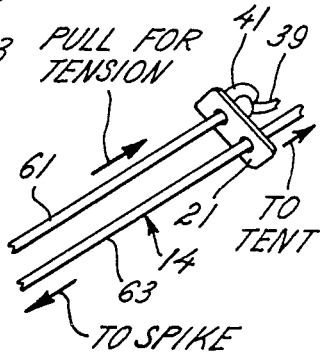

Holding the brace 21 in place and pulling on the free end 39 of the rope 14 as indicated in FIG. 3*d* draws the rope taut and creates tension along its length. As previously indicated, the tension in each of the two portions 61 and 63 of the rope 14 passing through the holes 35 and 37 of the brace 21 is in an opposite direction with respect to the tension in the other rope portion, thereby creating a torque about the brace which tends to bind the rope and prevent it from slipping through the brace. Specifically, tension in the rope portion 61 tends to draw the knot 41 back through the second hole 37 of the brace 21. Because of the knot's diameter, it cannot pass through the hole 37. Instead, it presses on one side of the brace 21 in response to the tension in the rope 14, thereby imparting a force in a direction generally toward the stake 45. The other rope portion 63, however, is under tension in a direction opposite to that of rope portion 61, thereby imparting a force to the brace 21, by way of the frictional engagement between the hole 35 and the rope 14, which is opposite that applied by the knot 41. The torque on the brace 21 resulting from these two opposite and spaced forces twists the brace 21 so that it effectively binds the rope portion 63 in place and prevents releasing of the tension in the rope.

To remove the rope 14 from the stake 45, the foregoing steps are simply reversed. By pulling on the free end 39 of the rope 14, the torque on the brace 21 is released, allowing the rope to slip through hole 35 and become slack. With the rope slack, the eye of the loop 19 is pulled up and over the top or second end 55 of the body portion 47 of the stake 45. With the eye of the loop 19 free from the body 47 of the stake 45, the loop can be drawn through the ring 49.

In summary, applicant has invented an improved staking apparatus and method which is inexpensive, rugged and easy to use. Unlike prior art devices and methods, the invention provides for easy adjustment of the rope after it has been initially secured to a stake. Frictional binding is virtually eliminated by the smooth interface between the rope and stake resulting from the ring 49 and the associated method of securing and tensioning the rope 14 to the stake 45.

What is claimed is:

1. A method of securing an article, having a rope extending therefrom, using an elongated stake having a sharp first end of a body portion for driving into a ground surface, a blunt second end, of said body portion for transferring a driving force to said body portion and a ring-shaped outrigger secured to said body portion proximate said second end and freely rotatable about a horizontal axis, said method comprising the steps of:

looping a free end of said rope;

drawing the loop formed by said free end of said rope through said ring-shaped outrigger;

passing the eye of said loop over said blunt second end of said body portion; and drawing said rope taut between said stake and said article, thereby rotating said ring-shaped outrigger upwardly about said horizontal axis and into a biased engagement with said body portion of said stake.

2. A method as set forth in claim 1 wherein said loop is held by a unitary brace having two adjacent holes, one hole for receiving said free end of said rope from a first side of said brace and a second hole for receiving said free end of said rope from a second side of said brace, thereby forming said loop.

3. A method as set forth in claim 2 wherein said rope is held taut by drawing said rope through one of said two adjacent holes in said brace until tension is created along the length of said rope and thereafter releasing said rope, said brace preventing the loss of tension in said rope by binding said rope in said one of said two adjacent holes as a result of the tension occurring in opposite directions with respect to the two portions of said rope passing through said holes.

* * * * *